United States Patent [19]

Sciarra

[11] Patent Number: 4,539,440

[45] Date of Patent: Sep. 3, 1985

[54] IN-CANAL HEARING AID

[76] Inventor: Michael Sciarra, 59 Far Pond Rd., Southampton, N.Y. 11968

[21] Appl. No.: 495,054

[22] Filed: May 16, 1983

[51] Int. Cl.[3] ..... H04R 25/00

[52] U.S. Cl. ..... 179/107 E; 381/68

[58] Field of Search ..... 381/68, 69, 104; 179/107 R, 107 E

[56] References Cited

U.S. PATENT DOCUMENTS

| | | | |
|---|---|---|---|
| 3,209,082 | 9/1965 | McCarrell | 179/107 E |
| 3,764,748 | 10/1973 | Branch | 179/107 E |
| 3,890,474 | 6/1975 | Glicksberg | 179/107 E |
| 4,133,984 | 1/1979 | Akiyama | 179/107 E |

FOREIGN PATENT DOCUMENTS

| | | | |
|---|---|---|---|
| 2825233 | 4/1979 | Fed. Rep. of Germany | 179/107 E |
| 598919 | 9/1957 | Italy | 179/107 E |
| 52-19905 | 2/1977 | Japan | 179/107 E |
| 55-47713 | 4/1980 | Japan | 381/104 |

OTHER PUBLICATIONS

"Touch Control", *Wireless World,* Nov. 1980, vol. 86, No. 1538, p. 84.

Killion, untitled paper, Industrial Research Prods., Inc.

Lim, Signal Processing for Speech Enhancement, MIT, Nov. 3, 1982.

Voroba, Perspectives on the State of Hearing Aid Fitting Practices, Audecibel, Spring, 1982.

Schaefer, Speech Processing for the Hearing Impaired, Georgia Inst. Tech.

Scharf, Psychoacoustics of Elementary Sounds, Northeastern University.

Braida et al., Hearing Aids–A Review of Past Research, ASHA Monographs, No. 19, 1979.

*Primary Examiner*—Gene Z. Rubinson

*Assistant Examiner*—L. C. Schroeder

*Attorney, Agent, or Firm*—Curtis, Morris & Safford

[57] ABSTRACT

An in-canal hearing aid is inserted and worn within the auditory canal of a hard-of-hearing wearer. This hearing aid has a generally-cylindrical body with a resilient stretchable outer layer and an adjustably expandable member therewithin for changing the diameter of the generally cylindrical body without significantly changing the length thereof. Hearing aid amplifying circuitry are contained within the generally cylindrical body. The body is hingedly flexible and a flex circuit connector is used to support the amplifying circuitry. These features permit rounding the curve of the auditory canal when the hearing aid is inserted. The body of the hearing aid can be selectively expanded for a snug, comfortable fit. A touch control permits the wearer to adjust the volume by touching a single control stem extending from the external end of the hearing aid.

10 Claims, 8 Drawing Figures

FIG.1A
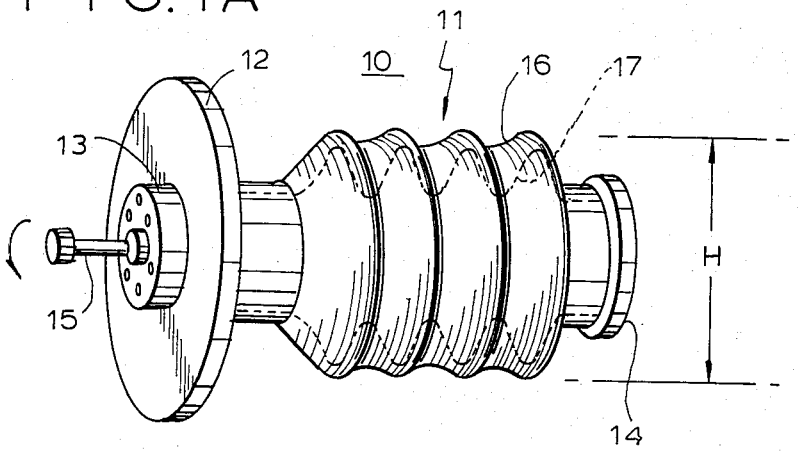
FIG.1B
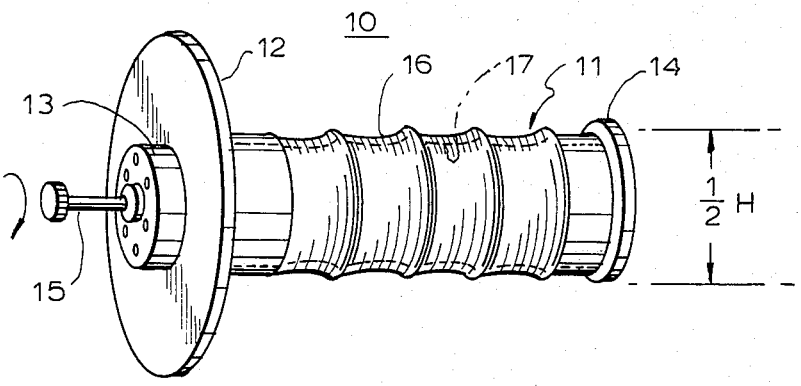
FIG.1C
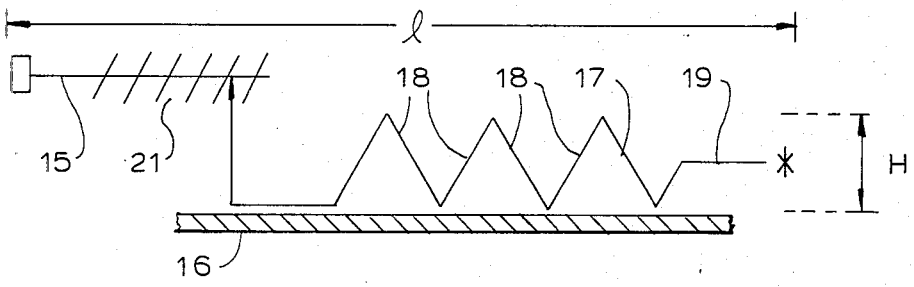
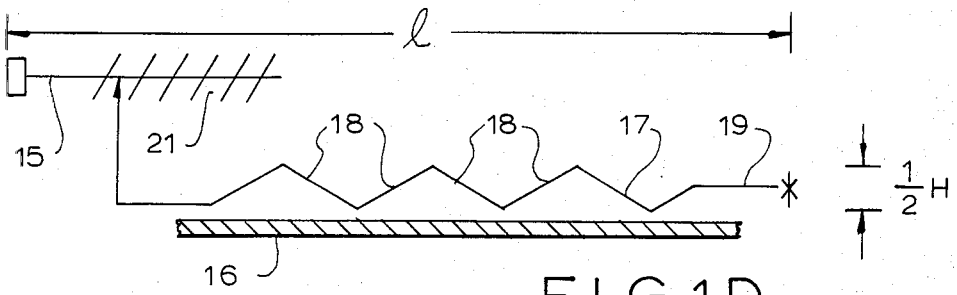
FIG.1D

IN-CANAL HEARING AID

This invention relates to hearing aids for persons with hearing losses, and is particularly directed to an improved hearing aid to be worn within the auditory canal of a wearer. The present invention is also directed to an improved in-canal hearing aid which can be easily inserted and removed by the wearer, and snugly fitted in the wearer's auditory canal upon insertion. The invention is further directed to such an in-canal hearing aid in which the volume, or degree of amplification, is easily adjusted while the in-canal hearing aid is being worn.

Persons with hearing deficiencies often suffer significant hearing losses in the frequency range of 1 KHz–8 KHz; this poses a significant problem because speech intelligence is concentrated into these frequencies. For example, losses in these frequencies make it particularly difficult to understand consonant sounds, such as "F" and "TH", and to differentiate one spoken word from another.

The traditional approach for hearing aids has been to amplify audio frequencies in the range in which the hearing losses occur, and at the same time to remove as much low-frequency information (below 150 Hz) as possible. Also, because many amplifiers will go into a saturation condition when too much power is required of them, previous hearing aids have traditionally been designed to have a high frequency response with a roll off beginning at or below about 4 KHz. This concentrates the amplified audio signal in what are commonly believed to be the "frequencies of interest", even though these may be the same frequencies where the hearing losses occur. The conventional wisdom behind this is that by removing the higher and lower frequencies, there would be less to "mask" the "frequencies of interest".

Audiologists are now beginning to understand that hard of hearing persons with deficiencies in the range corresponding to the "frequencies of interest" rely heavily on other frequencies, particularly on high frequency information (i.e., audio sounds in the range above about 8 KHz) for "cues" to compensate for informational losses in the range of "frequencies of interest."

However, when a hearing aid is adapted to amplify these higher frequencies, some provision must be made for avoiding or accommodating standing waves which can occur because of the short wavelength at these frequencies. At frequencies over 8 KHz, a quarter wavelength corresponds to a distance of as short as 0.1 inches. Unfortunately, if the hearing aid is to be inserted in the ear or coupled to the outer ear, there can easily a change in insertion depth of the order of 0.1 inches from one insertion of the hearing aid to another. If the distance from the tympanic membrane to the hearing aid's speaker transducer corresponds to a nodal point, the user will hear a significantly louder volume (or sound pressure level) than he or she would hear if the distance happened to coincide with an antinodal point. For this reason, it is extremely desirable that an in-the-ear hearing aid should be adapted to be placed deeply within the auditory canal and a consistent distance from the tympanic membrane each insertion, and thereby to eliminate or minimize the effects of nodes and antinodes in the sound pressure level. Then, these high frequencies can be consistently presented to the wearer, and less energy is required to power the hearing aid.

Unfortunately, no practical in-canal hearing aid has previously been proposed which achieves a reliable and consistent snug fit in the auditory canal each time it is inserted.

This problem is more complicated in that in most persons, there is a bend in the auditory canal which the hearing aid would have to pass to be inserted.

Also, as the hearing aid or any other type of device is worn in the canal, the auditory canal itself tends to expand in diameter. As as result, a device worn within the ear will tend eventually to become loose. This can lead to feedback from the output transducer to the input transducer through voids in the seal between the canal and the hearing aid. This, in turn, can result in an annoying squeal, and limits the amount of amplification which can be provided by the hearing aid.

Accordingly, it is an object of this invention to provide an in-canal hearing aid which can be inserted into the auditory canal, removed, and consistently and reliably reinserted, and which avoids all of the problems mentioned above which have not been solved in the prior art.

It is a more particular object of this invention to provide a hearing aid which can be inserted in the auditory canal, after which its diameter can be selectively adjusted by the wearer by manipulation of a simple control, so as to fit snugly and eliminate voids in the seal between the auditory canal and the hearing aid.

It is another object of this invention to provide an in-canal hearing aid, as aforesaid, which is sufficiently flexible to allow passage of the aid past the bend which normally occurs in the auditory canal of a wearer.

It is still another object of this invention to provide an in-canal hearing aid in which the volume can be selectively controlled, once the hearing aid is in place in the auditory canal, by touching a single control on the hearing aid.

In accordance with an aspect of this invention, an in-canal hearing aid is adapted to fit within the auditory canal of a hard-of-hearing wearer. This hearing aid generally comprises a more-or-less cylindrical body including a resilient strechable outer layer for contacting the walls of the auditory canal, and an adjustably expandable member, for example, formed of an accordion spring, disposed within the outer layer. This arrangement permits the diameter of the cylindrical body to be changed without significantly changing the length of the cylindrical body.

Within this cylindrical body is disposed the hearing aid circuitry. This circuitry includes a power source cell, an audio amplifier, a microphone or audio input transducer disposed at the outer end of the generally cylindrical body, and an output audio transducer disposed at the other, or tympanum-end of the generally cylindrical body, and an adjusting circuit for adjusting the gain of the audio amplifier. Preferably, the audio amplifier and the transducers are mounted on a flex circuit. This flex circuit and the accordion spring member permit the hearing aid to sustain bending when the hearing aid is inserted into the ear.

An adjusting stem extending from the outer end of the generally cylindrical body permits the selective expansion of the adjustably expandable member once the hearing aid is inserted, so that the generally cylindrical body fits snugly in the wearer's auditory canal.

In order to control the volume, the circuitry also includes a digital gain control circuit for selectively controlling the gain of the audio amplifier. A touch switch is operatively associated with the adjusting stem so that the wearer can adjust the volume up or down, as desired, by touching the adjusting stem until the desired volume is reached.

The above and many other objects, features, and advantages of this invention will become apparent in the following detailed description of an illustrative embodiment thereof, which is to be read in connection with the accompanying drawings, where:

FIGS. 1A and 1B are perspective views and FIGS. 1C and 1D are schematic representations of an in-canal hearing aid according to one embodiment of this invention.

Figure 2:
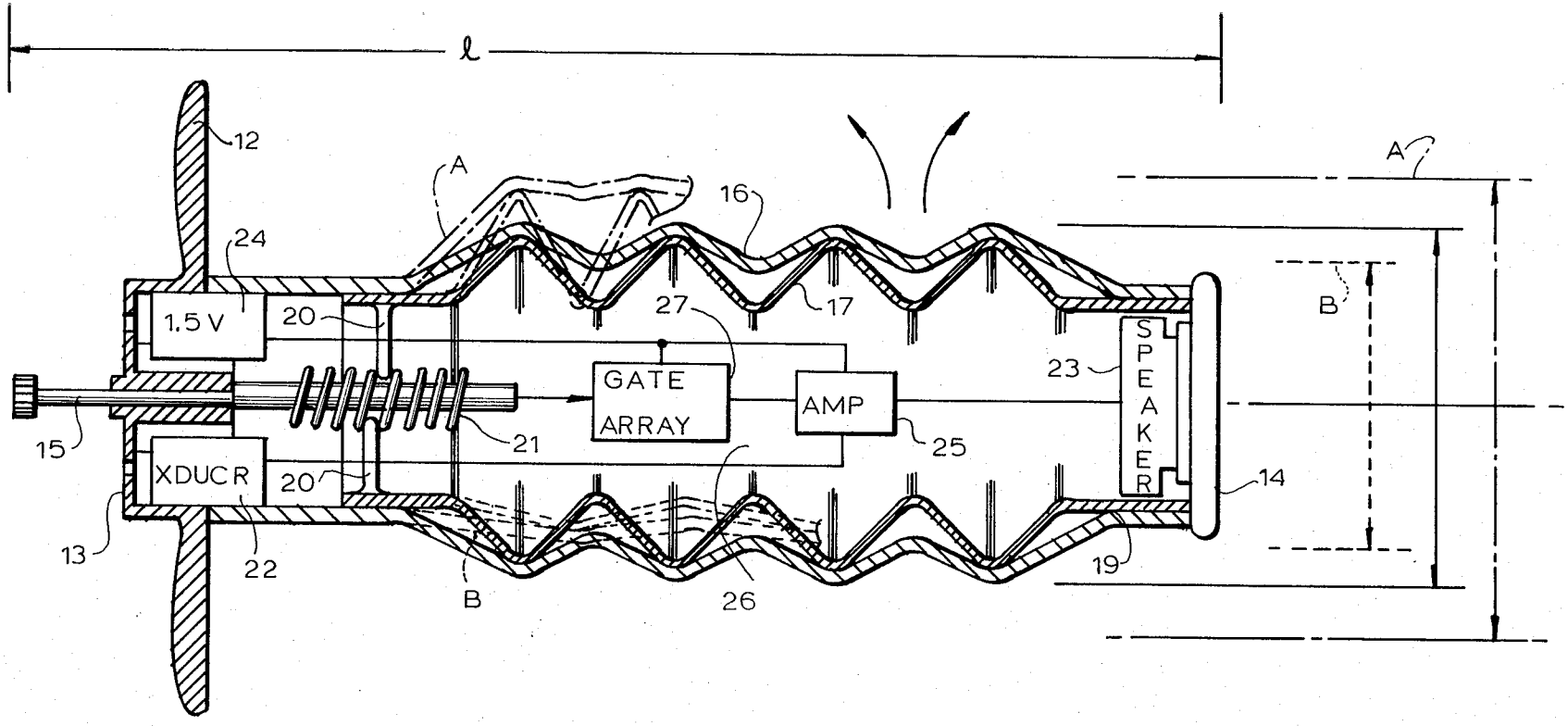
FIG. 2 is a perspective view in partial section showing the described embodiment of this invention.

Referring now to the drawings in detail, FIGS. 1A and 1B thereof depict an in-canal hearing aid 10 constructed according to one embodiment of this invention. The hearing aid 10 has a generally cylindrical body 11 dimensioned to fit into the auditory canal of a hard-of-hearing person. An insertion stop 12 extends radially from the body 11 near an exterior end 13 thereof. Being of greater radial extent than the wearer's auditory canal, the insertion stop 12 lodges against the external ear at the entrance of the auditory canal. This prevents the aid 10 from being inserted too far into the ear so it must be "fished out" by a physician, and also serves to locate the aid 10 a consistent depth in the auditory canal so that an interior end 14 thereof is disposed at a consistent distance from the tympanic membrance of the wearer's ear.

As shown in FIGS. 1A and 1B, the cylindrical body 11 is formed of a resiliently strechable outer skin 16 disposed over an accordion spring member 17. The skin 16 can favorably be formed of a flexible medical grade elastomer, such as Silastic (TM).

An adjusting stem 15 extends a short distance outward from the exterior end 13 of the aid and serves to permit the wearer to adjust the diameter of the cylindrical body 11 for a snug, yet comfortable fit.

As shown in FIGS. 1C and 1D, the spring member 17 has a plurality of folds or occlusions 18 and is anchored at one end 19 thereof to the interior end 14 of the cylindrical body. A pawl 20 disposed at the other, free end of the spring member 17 engages a plate-type ratchet 21 on the interior end of the adjusting stem 15. The anchored end 19 of the spring member 17 and the adjusting stem 15 are disposed with a fixed length l separating them. Thus, if the stem 15 is rotated in one direction, as shown in FIGS. 1A and 1C, the pawl 20 moves towards the anchored end 19 pushing the skin 16 outward and expanding the body 11 to a maximal radial extend H. However, if the stem 15 is twisted in the other direction, as shown in FIGS. 1B and 1D, the pawl 20 moves away from the anchored end 19 of the spring member 17, thereby flattening it and allowing the skin 16 of the body portion 11 to collapse to a minimum diameter, here ½H.

A more detailed illustration of the hearing aid according to this embodiment of the invention is shown in FIG. 2:

As shown in FIG. 2, a microphone, or input transducer 22 is disposed near the exterior end 13 and a speaker or output transducer 23 is disposed near the interior end 14 of the generally cylindrical body 11. A hearing aid cell 24, which can be 1.5 volt cell, is disposed in the body portion 11 near the exterior end 13 and serves as a power source for the hearing aid electronics. These electronics include an audio amplifier 25 connected by a flex circuit connection 26 to the transducers 22, 23, to the cell 24 and to a gate array module 27 actuated by the stem 15. The flex circuit connection 26 can be formed of a flexible film circuit board with flexible thin metallic leads printed thereon. The module 27 controls the volume of the hearing aid 10 and turns it on and off.

As shown in A of FIG. 2, moving the stem 15 in one direction causes the ratchet plate 21 attached thereto to move the pawl 20 outward so that the diameter at the occlusions 18 is reduced, as shown in dotted lines. Moving the stem 15 in the other directions move the pawl 2 inwardly, thereby increasing the diameter at the location of the occlusions, as shown in chain lines B in FIG. 2. Also, this accordion spring 17 acts as a resilient hinge and permits flexion or bending of the hearing aid 10 in either the upward/downward direction, as illustrated by the curved arrows in FIGS. 2A and 2B, or in the direction into/out of the drawing. The flex circuit connection 26 of the hearing aid electronics also permits bending of the hearing aid electronics. These features in combination permit the hearing aid 10 to be inserted beyond the natural bend in the auditory canal.

An internal venting tube permits equalization of the pressures on the two ends 13, 14 of the hearing aid, that is, equalizes the ambient pressure on the tympanic membrane with that of the environment. However, this venting tube is dimensioned so as to prevent audio feedback to the microphone or input transducer.

Details of the electronics such as the amplifier 25 and the gate array module 27 can be explained with reference to FIGS. 3 and 4.

Figure 3:
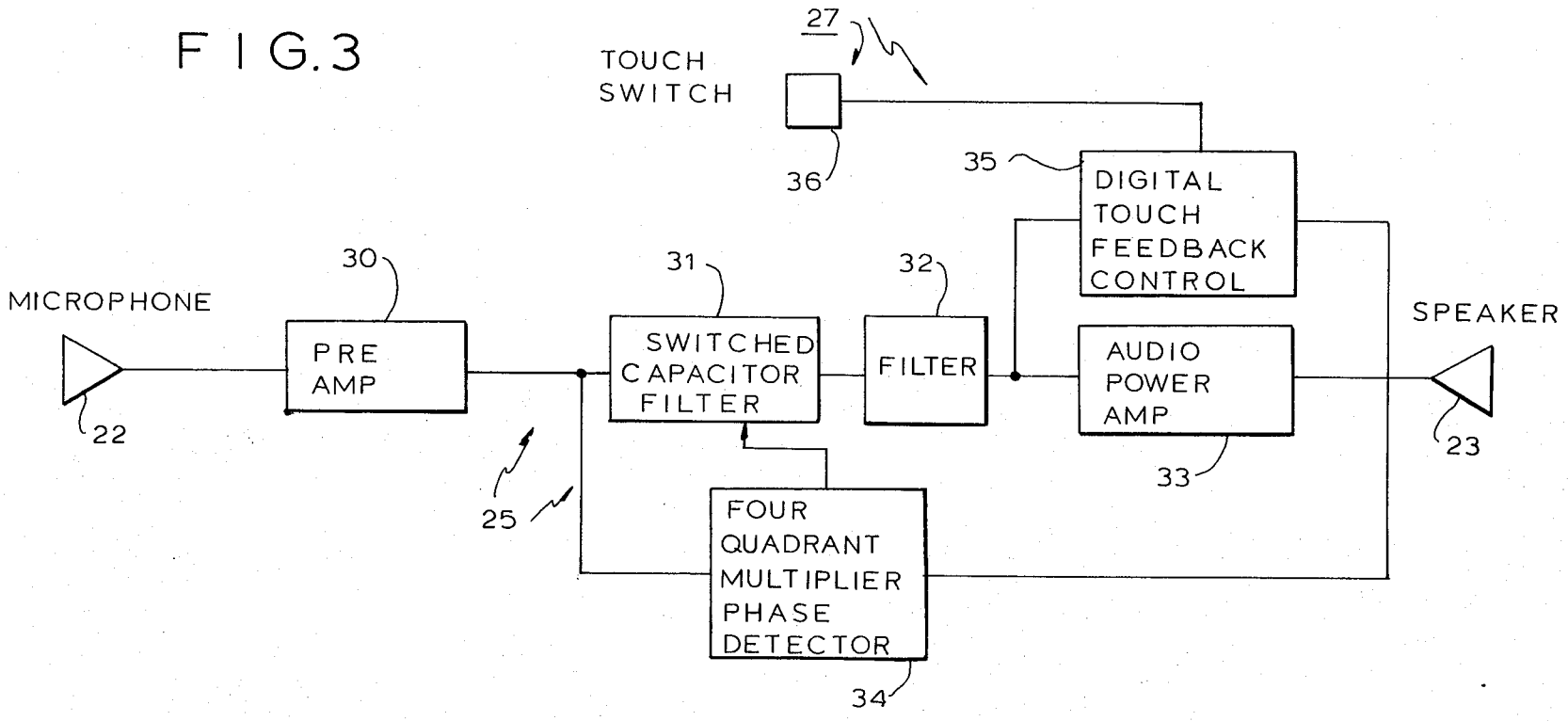
FIG. 3 is a schematic diagram of electronic circuitry of the hearing aid according to one embodiment of this invention.

As shown in FIG. 3, the microphone 22 is coupled to a bipolar front-end preamplifier 30 having a fixed gain of, e.g., 10 dB. This preamplifier 30 serves to offset the inherent noise in the CMOS miniaturized elements which follow it. The output of the preamplifier 30 is applied through a switched capacitor filter 31 and a variable-state bandpass filter 32 to an audio power amplifier 33. The latter is favorably composed of CMOS operational amplifiers, and can have a gain of, e.g., 120 dB. A four-quadrant multiplier phase detector 34 has inputs coupled to the outputs of the preamplifier 30 and the power amplifier 33, respectively, and an output coupled to control the switched capacitor filter 31. The output of the audio power amplifier 33 is also, of course, applied to the speaker transducer 23.

The gate circuit 27 for controlling the volume includes a digital touch feedback control circuit 35 coupled between the output of the power amplifier 33 and the input thereof, and a touch switch 36. The latter circuitry is better explained with reference to FIG. 4.

Figure 4:
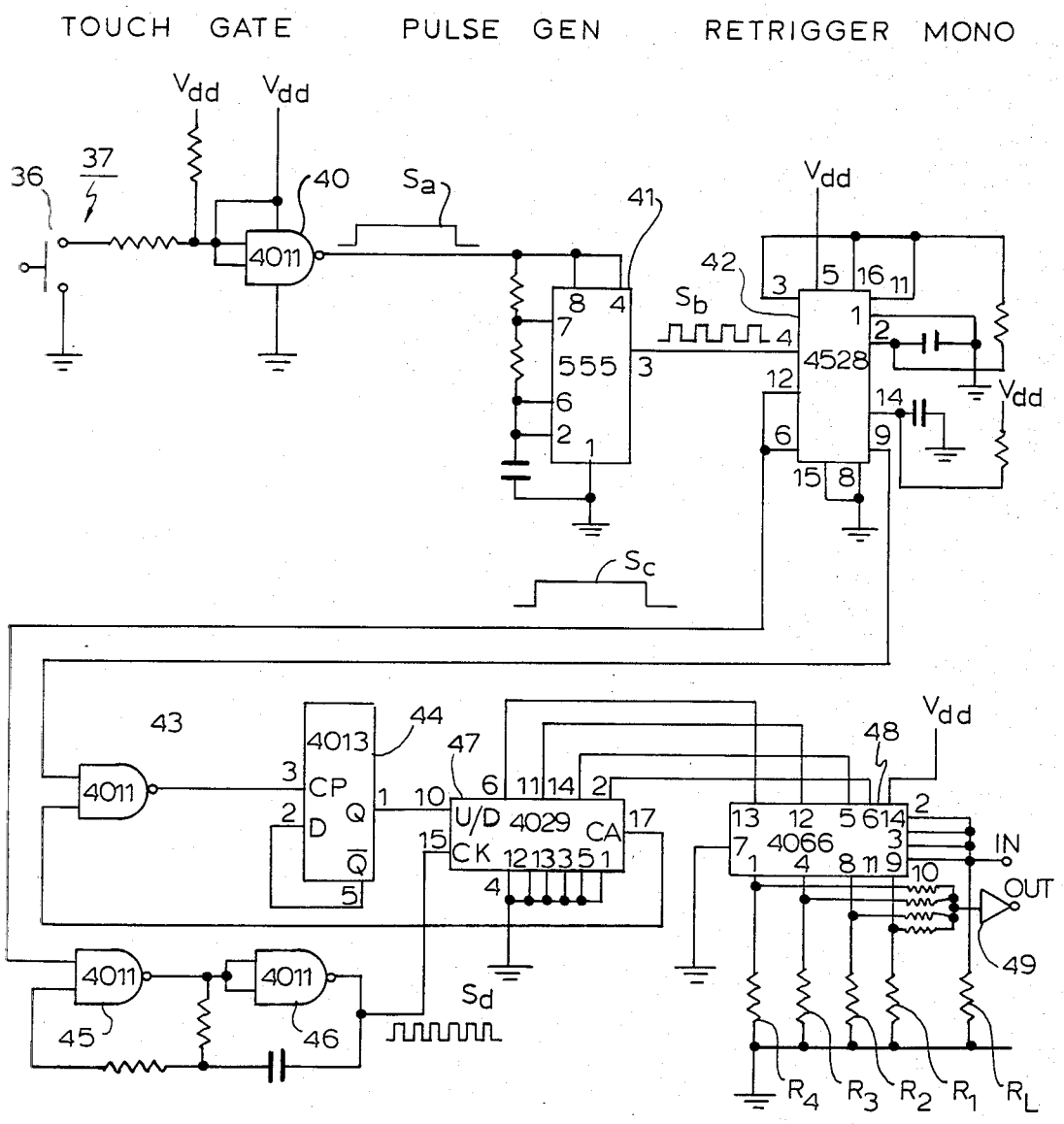
FIG. 4 is detailed schematic diagram illustrating a touch-actuated volume adjusting circuit forming a portion of the electronics illustrated in FIG. 3.

As shown in FIG. 4, the touch switch 36 can be selectively closed to ground a contact 37 thereof coupled to a touch gate circuit 40. The latter is favorably formed of a CMOS NAND gate, such as a type 4011 integrated circuit. Closing the switch 36 causes the touch gate 40 to emit a pulse signal $S_a$, which in turn actuates a pulse generator 41. This pulse generator, favorably be formed of a type 555 integrated circuit, emits a pulse train $S_b$ for the duration of the pulse signal $S_a$. This pulse train $S_b$ is furnished to a trigger input of a retriggerable monostable multivibrator circuit 42, here formed of a type 4528 timer. This retriggerable monostable multivibrator serves to provide a bounceless pulse signal $S_c$ in response to closing of the switch 36. The circuit 42 also provides a pulse signal from its pin-9 terminal to an input of a logic circuit formed of a second NAND gate 43, whose output is coupled to a clock input of a D-type flip flop 44.

Third and fourth NAND gates 45 and 46 are coupled together to form a clock pulse generating circuit. The signal $S_c$ from the retriggerably monostable circuit 42 is applied to one input of the third NAND gate 45 to turn on the clock pulse generating circuit 45, 46, so that the fourth NAND gate 46 thereof emits a clock pulse train $S_d$ for the duration of the signal $S_c$.

A four-bit counter 47 has a clock terminal coupled to receive the clock pulse train $S_d$, a carry, or overflow bit terminal coupled to a second input terminal of the NAND gate 43, and an up/down control terminal coupled to the Q output terminal of the flip flop 44.

The counter 47 has four counting terminals, each of which is coupled to a corresponding switch control terminal of a quad bilateral switch 48. This switch 48 has input terminals coupled together to an input terminal IN and to one side of load resistor $R_L$, the other side of which is connected to ground. The switch 48 has its output terminals each coupled to ground to respective progressively valued resistors $R_1$, $R_2$, $R_3$, and $R_4$. These output terminals are also connected through an output circuit 49 to an output terminal OUT. The input terminal IN and the output terminal OUT are then connected respectively to the output and input of the audio amplifier 33.

Thus, it should be understood that each time the touch switch 36 is closed, the counter 47 will count up or down in response to the pulses of the pulse train $S_d$, and the quad bilateral switch 48 will correspondingly change by steps the level of the signal applied as feedback to the input of the amplifier 33.

The flip flop 44 serves to cause the counter 47 to count up and down alternately with successive actuations of the switch 36. Also, because the carry or overflow signal is also supplied from the counter 47 through the NAND gate 43 to the flip flop 44, the direction of counting of the counter 47 will automatically reverse when the counter 47 attains a maximum value.

The switch 36 is closed by lightly touching the stem 15 while the hearing aid 37 is in place in the auditory canal of the wearer.

The operation and consequent advantages of this in-canal hearing aid 10 ensue from its unique and novel construction.

The hearing aid 10, being hingedly flexible, can round the curve in the auditory canal, permitting the hearing aid 10 to approach the wearer's tympanic membrane closer and to a more consistent distance than conventional hearing aids. This permits the power level required for the hearing aid to be reduced for any given sound pressure level at the tympanic membrane.

The accordion-like spring 17 is adjusted by the stem 15, once the hearing aid is inserted, to establish a constant-pressure, air-tight fit against the walls of the auditory canal. Consequently, the constant tension applied to the canal effectively seals the canal from unwanted air passage, through which acoustic feedback can be generated. This prevents unwanted squeal or other feedback noise. In addition, unlike other hearing aids, continual professional refitting is not required as a consequence of the changing of the dimension of the auditory canal. This is because the wearer can readjust the tension and sealing characteristics as desired for the most comfortable fit.

As the hearing aid is installed, adjusting the lateral dimension of the hearing aid 10 by means of the stem 15 actuates the on/off switch (not specifically shown) in the gate array 27, and turns the hearing aid 10 on. The aid 10 can be removed by gripping the stem 15 and gently pulling outwards. Withdrawing the hearing aid 10 by use of the stem 15 turns the unit off.

Volume is controlled by touching the stem 15. The volume on gain will then increase so long as the wearer maintains his or her finger on the stem 15. Then, touching the stem 15 a second time causes the volume to decrease.

In order to provide sufficient voltage for the CMOS circuitry, a DC-DC converter, favorably of the charge-pump type, can be included in the electronic circuitry to boost the supply voltage from the cell's nominal 1.5 volts to 3 volts.

Also, the power cell 24 is favorably contained in a sealed enclosure behind the external end 13 of the hearing aid 10. This external end 13 can be unscrewed to permit removal and replacement of the cell 24.

Moreover, the audio power amplifier 33 can be formed of digital construction, in which digitizing first takes place by means of an analog-to-digital converter, then wave shaping and filtering are carried out in notch and bandpass circuits using digital filter techniques. These filters have responses which are set, for example, on chip-programmable resistor ladder networks. Then, the output of the digital filters is converted back to an analog signal by means of a digital-to-analog converter.

The circuit of this invention is quite economical and requires a minimum of discrete parts, these being a capacitors in the DC-to-DC converter, and resistors in the filter and wave shaping circuits. Current drain is quite low, typically from 0.3 ma to 1.6 ma, depending on volume. Because the operating voltage is brought to 3 volts, high-frequency operation is flat from 50 to 20,000 Hz.

The hearing aid of this invention can be tailored electrically for each specific hearing-deficient wearer, without the need for an audiologist to carry a large inventory of discrete capacitors and resistors. That is, the amplifiers and filters contained in this hearing aid track the unbalanced impedence of the speaker or output transducer 23, thus providing a flat response from about 50 to about 20,000 Hz. The audiologist or auditory professional can then taper this response electrically simply by adjusting the connections of the contact pins in the amplifier and filter circuits. This also avoids the need to resort to acoustical amplifying and resonating techniques.

Figure 5:
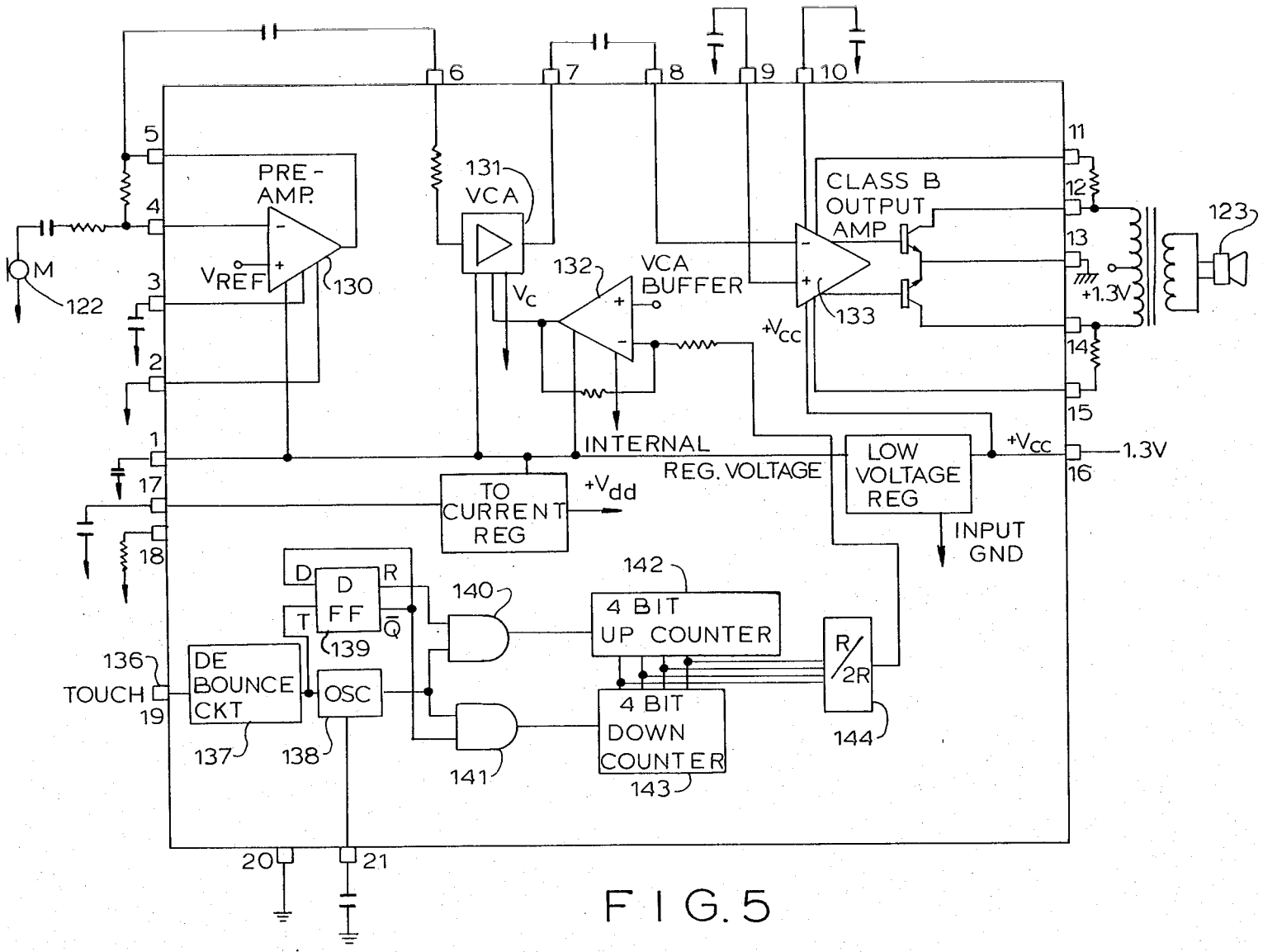
FIG. 5 is a schematic diagram of an alternative embodiment of this invention.

FIG. 5 shows another configuration for the electronics according to this invention. The salient elements thereof are arranged as follows.

A microphone transducer 122 is coupled through a preamplifier 130 to a voltage controlled amplifier 131, a control voltage for which is supplied by a buffer amplifier 132. The amplifier 131 feeds a class B output amplifier 133 which drives an output speaker transducer 123.

A touch switch electrode 136 is coupled through a debounce circuit 137 to control an oscillator 138 and a D flip flop 139. These both have outputs coupled through AND gates 140 and 141 to counters 142 and 143, connected as an up counter and a down counter, respectively.

Alternate actuations of the touch switch electrode 136 cause these counters 142, 143 to count up and count down. These counters 142 and 143 have outputs connected to a resistor ladder network 144 to control the output of buffer amplifier 132, and hence the gain of the amplifier 131.

As shown in FIG. 5, the entire circuit can be integrated as a single chip.

Although an illustrative embodiment of the present invention has been described herein with reference to the accompanying drawings, it is to be understood that the invention is not limited to those precise embodiments and that various changes and modifications may be effected therein by one skilled in the art without departing from the scope or spirit of this invention. What is claimed is:

1. An in-canal hearing aid adapted to fit within the auditory canal of a wearer comprising a generally cylindrical member including a resilient stretchable outer layer for contacting the walls of the auditory canal, and an adjustably expandable member disposed within said outer layer for changing the diameter of said outer layer without significantly changing the length of the cylindrical member;

hearing aid amplifying means disposed within said generally cylindrical member and including power source means, audio amplifier means, an input audio transducer disposed at one end of said generally cylindrical member and coupled to an input of said audio amplifier means, an output audio transducer disposed at the other end of said generally cylindrical member and coupled to an output of said audio amplifier means, and means for adjusting the gain of said audio amplifier means; and adjusting means extending from the one end of said generally cylindrical member for selectively expanding said adjustably expandable member such that the generally cylindrical member fits snugly in the wearer's auditory canal; said generally cylindrical member being flexibly hinged to permit axial flexing, such that the hearing aid can accommodate the curvature of the auditory canal.

2. An in-canal hearing aid according to claim 1, wherein said hearing aid amplifying means further includes a flex circuit connecting member to couple said audio amplifier means and said transducer means together to accommodate bending of said generally cylindrical member.

3. An in-canal hearing aid adapted to fit within the auditory canal of a wearer comprising a generally cylindrical member including a resilient stretchable outer layer for contacting the walls of the auditory canal, and an adjustably expandable member disposed within said outer layer for changing the diameter of said outer layer without significantly changing the length of the cylindrical member;

hearing aid amplifying means disposed within said generally cylindrical member and including power source means, audio amplifier means, an input audio transducer disposed at one end of said generally cylindrical member and coupled to an input of said audio amplifier means, an output audio transducer disposed at the other end of said generally cylindrical member and coupled to an output of said audio amplifier means, and means for adjusting the gain of said audio amplifier means; and adjusting means extending from the one end of said generally cylindrical member for selectively expanding said adjustably expandable member such that the generally cylindrical member fits snugly in the wearer's auditory canal; said adjustably expandable member including an accordian spring member having a free end, another end anchored to said outer layer at said other end of said generally cylindrical member, and a plurality of occlusions disposed between said ends.

4. An in-canal hearing aid according to claim 3, wherein said adjusting means includes a rotatable stem extending from said one end of said generally cylindrical member, and said free end of said accordion spring member includes at least one member engaging said stem to move said free end axially in response to rotation of said stem.

5. An in-canal hearing aid according to claim 1, further comprising insertion stop means, of greater radial extent than said generally cylindrical member, for lodging against an outer portion of the auditory canal to ensure that the hearing aid is in position to be removable by the wearer.

6. An in-canal hearing aid adapted to fit within the auditory canal of a wearer comprising a generally cylindrical member including a resilient stretchable outer layer for contacting the walls of the auditory canal, and an adjustably expandable member disposed within said outer layer for changing the diameter of said outer layer without significantly changing the length of the cylindrical member;

hearing aid amplifying means disposed within said generally cylindrical member and including power source means, audio amplifier means, an input audio transducer disposed at one end of said generally cylindrical member and coupled to an input of said audio amplifier means, an output audio transducer disposed at the other end of said generally cylindrical member and coupled to an output of said audio amplifier means, and means for adjusting the gain of said audio amplifier means; and adjusting means extending from the one end of said generally cylindrical member for selectively expanding said adjustably expandable member such that the generally cylindrical member fits snugly in the wearer's auditory canal; and switching means for coupling said power source means to said amplifier means, said switching means being actuated by said adjusting means, such that said switching means are turned on when said wearer actuates the adjusting means to expand said expandable member.

7. An in-canal hearing aid according to claim 6, wherein said adjusting means is adapted for gripping by the wearer and pulling for removal of the hearing aid from the auditory canal, and said switching means turns off in response to pulling of said adjusting means to remove said hearing aid.

8. An in-canal hearing aid adapted to fit within the auditory canal of a wearer comprising a generally cylindrical body insertable into the canal and selectively radially expandable to fit snugly in the canal;

hearing aid amplifying means disposed within said generally cylindrical body and including power source means, audio amplifier means, an input audio transducer disposed at one end of said generally cylindrical body and coupled to an input of said audio amplifier means, an output audio transducer disposed at the other end of said generally cylindrical body and coupled to an output of said audio amplifier means, and digital gain control means for selectively controlling the gain of said audio amplifier means at the option of the wearer; and adjusting means disposed at said one end of said generally cylindrical member and coupled to said digital gain control means so that the user can selectively increase or decrease the gain of the audio amplifier means by touching the adjusting means;

said audio amplifier means including a preamplifier followed by a power amplifier, and said gain control means including a digital touch feedback circuit having an input coupled to an output of said power amplifier, an output coupled to an input of said power amplifier, and a touch control terminal coupled to said adjusting means; said digital touch feedback circuit including touch means generating a pulse signal while said wearer touches said adjusting means, pulse generating means providing counter pulses during said pulse signal, counter means selectively counting said counting pulses up or down, and feedback circuit means responsive to the count on said counter means to provide a version of the amplified signal from the output of said power amplifier to the input thereof as a feedback signal;

said counter means having a plurality of binary count terminals, a clock input terminal coupled to said pulse generating means, and an up/down control terminal; said feedback circuit means including a bilateral switch circuit having a plurality of inputs, a like plurality of outputs, and a like plurality of control terminals each coupled to a respective one of said binary count terminals, with load resistor means being coupled to either of said inputs and said outputs, and a plurality of progressively-valued resistors being coupled respectively to other of said inputs and said outputs of the bilateral switch circuit.

9. An in-canal hearing aid according to claim 8, wherein said digital touch feedback circuit also includes a flip-flop having an input coupled to said touch switch means and an output coupled to the up/down control terminal of said counter means, so that successive actuations of said adjusting means alternate the direction of counting of said counter means.

10. An in-canal hearing aid according to claim 9, further comprising logic circuit means interposed between said flip-flop and said touch switch means and having an output coupled to the input of the flip-flop, a first input coupled to said touch switch means, and a second input coupled to a carry terminal of said counter means, so that the counter means is caused to change its direction of counting both upon successive actuations of the touch switch means and also upon said counter means attaining a count corresponding to an end of its counting range.

* * * * *